US005824945A

United States Patent [19]

Barlog et al.

[11] Patent Number: 5,824,945

[45] Date of Patent: Oct. 20, 1998

[54] DISTRACTION DEVICE

[75] Inventors: Stanley J. Barlog; Michael C. Magenot, both of Phoenix; Wilburn C. Roberts, Mesa, all of Ariz.

[73] Assignee: Universal Propulsion Company, Inc., Phoenix, Ariz.

[21] Appl. No.: 751,219

[22] Filed: Nov. 15, 1996

[51] Int. Cl.[6] ..... F42B 27/00; F42B 8/00; F42B 4/00

[52] U.S. Cl. ..... 102/482; 102/486; 102/487; 102/498; 102/335

[58] Field of Search ..... 102/334, 367, 102/368, 482, 486, 487, 488, 335, 355, 356, 361, 407, 293, 498, 401; 89/1.11

[56] References Cited

U.S. PATENT DOCUMENTS

| | | | |
|---|---|---|---|
| 1,961,364 | 6/1934 | Hunter | 102/368 |
| 1,994,081 | 3/1935 | Willners | 102/487 |
| 2,398,545 | 4/1946 | MacMillan et al. | 102/334 |
| 3,492,945 | 2/1970 | Filippi | 102/334 |
| 3,508,518 | 4/1970 | Flynn | 102/334 |
| 3,795,197 | 3/1974 | Levenson | 102/368 |
| 4,697,521 | 10/1987 | Espagnacq et al. | 102/334 |
| 4,932,328 | 6/1990 | Pinkney et al. | 102/482 |
| 4,938,144 | 7/1990 | Demarest | 102/334 |
| 5,085,147 | 2/1992 | Gold et al. | 102/486 |
| 5,094,168 | 3/1992 | Rumer | 102/334 |
| 5,610,359 | 3/1997 | Spector et al. | 102/334 |

FOREIGN PATENT DOCUMENTS

| | | | |
|---|---|---|---|
| 2642160 | 7/1990 | France | 102/367 |
| 2683626 | 5/1993 | France | 102/367 |
| 1216158 | 5/1966 | Germany | 102/334 |

*Primary Examiner*—Charles T. Jordan
*Assistant Examiner*—Theresa M. Wesson
*Attorney, Agent, or Firm*—Pennie & Edmonds LLP

[57] ABSTRACT

A distraction device having a fuse assembly and a body which body has a sealed storage area for energetic pyrotechnic material. The device when operated produces noise and light without ejecta or forces of propulsion.

8 Claims, 2 Drawing Sheets

DISTRACTION DEVICE

BACKGROUND OF THE INVENTION

Prior devices have been proposed with stun charges mountable in a steel body which body has pressure relief holes (U.S. Pat. No. 4,932,328). Prior art devices with pressure relief holes have been propelled by gases escaping from such holes.

SUMMARY OF THE INVENTION

Broadly, the present invention comprises a distraction device for creating a loud noise and a bright flash of light without expelling ejecta and without being propelled. The device has a fuse assembly and a body with a cylindrical central portion and two polygonal ends for resisting rolling of the device. An environmental charge holder (i.e., plastic) containing energetic pyrotechnic material is positioned in the body of the device.

The charge holder provides a sealed pyrotechnic material holder portion formed by an elongated holder wall, preferably cylindrical, an isolation disk at one end and a sealed end piece at the other end. The isolation disk separates during storage the fuse material from the pyrotechnic material. Upon initiation the burning fuse material penetrates the disk igniting the adjacent pyrotechnic material causing the end piece to be blown away from the body to create noise and light and to allow gases to escape through vent holes. Vent holes are strategically located in the body such that the reaction of the venting gases does not create forces to propel the device.

DESCRIPTION OF THE PREFERRED EMBODIMENT

Figure 1:
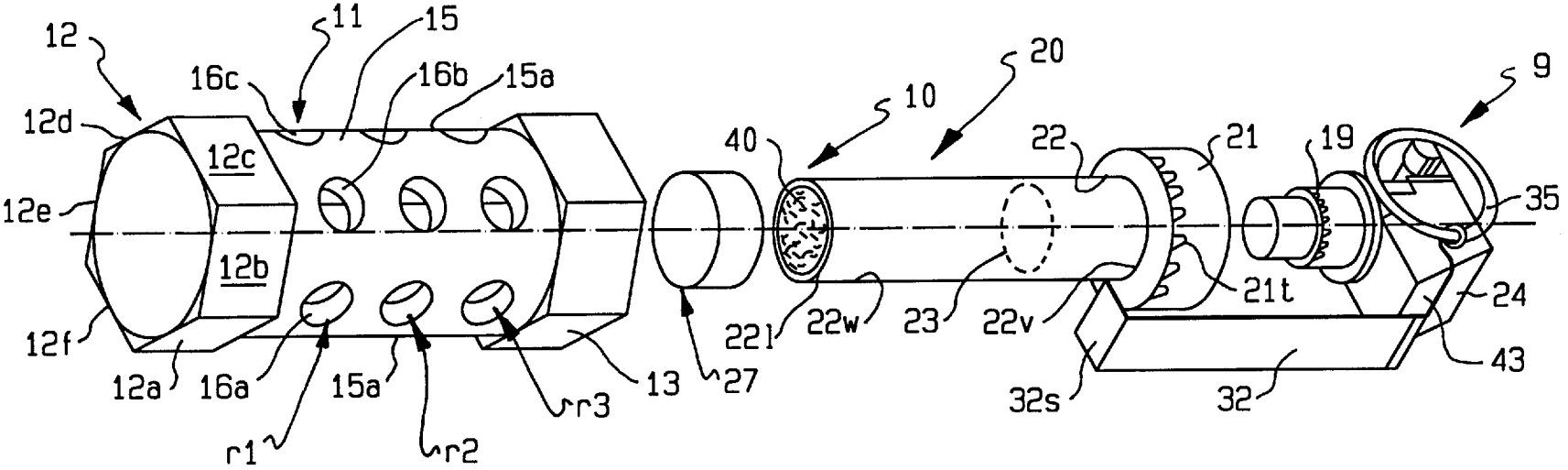
FIG. 1 is an exploded prospective view of the device.

In the Figures, device 10 includes fuse assembly head 9, a cylindrical body 11 including polygonal (i.e. hexagonal) end portions 12, 13 and cylindrical center portion 15 with six (6) vent holes 16 at each location $r_1$, $r_2$ and $r_3$. Body 11 is made of aluminum or any other material which rapidly dissipates heat. Rapid dissipation of heat cools down body 11 to allow reloading of device 10 within a short time after use, all as further explained. Holes 16 also function to transmit light. End portions 12, 13 each have six (6) flat surfaces 12*a–f* and 13*a–f*, respectively, in the preferred embodiment to resist rolling of the device. End portion 13 has threaded opening 17 (FIG. 2) for receiving plastic charge holder unit 20 which in turn comprises (a) a threaded neck portion 21 with threads 21*t* and (b) a holder portion 22. Holder portion 22 has wall 22*w* which extends from upper end 22*v* to lower end 22*l* which wall 22*w* is divided by an isolation disk 23 which isolates fuse material 37 from pyrotechnic material 40 (see FIG. 2). Neck portion 21, holder portion 22 and disk 23 are preferably molded as a single piece. Attached to the end of holder portion 22 is end closure 27.

Holder unit 20 and end closure 27 are molded of thermoplastic material that is self-extinguishing, resists moisture deterioration, fungi, ultraviolet and gamma radiation and is nontoxic. Holder portion wall 22*w*, disk 23 and closure 27 form a sealed chamber in which pyrotechnic material 40 is held for storage prior to use of device 10 to prevent moisture or other contamination of material 40.

Plastic holder unit 26 has a diameter, a wall 22*w* of sufficient thickness and other structural characteristics such that it does not rupture during operation. End closure 27 is bonded by gluing or otherwise to the end of holder portion 22. End closure 27 is blown off the end of the holder portion 22 upon initiation without rupture thereof. Thus, no ejectas are created or expelled from device 10 that might strike adjacent personnel. Only gaseous products exit device 10.

Figure 2:
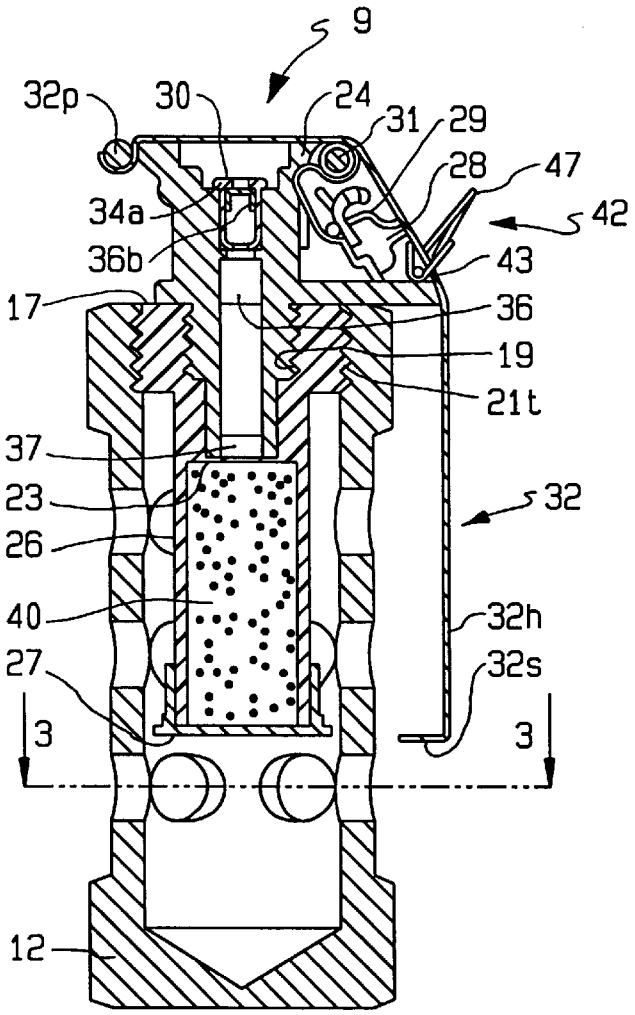
FIG. 2 is a longitudinal sectional view through the device.

Turning to FIG. 2, fuse adaptor assembly head 9 includes adaptor head 24 having mounted on it striker 28 which is rotatable in a counterclockwise direction about pivot pin 31 when urged by striker spring 29. Safety lever 32 including hand gripping portion 32*h* and spacer section 32*s* is pivotal about pivot 32*p*. Lever 32 is held by a cotter pin and ring assembly 35 (shown in FIG. 1) to prevent striker 28 from being activated until lever 32 is released. Head 24 further includes a passage having therein aligned in tandem a primer 30 including its housing 34*a* and dome 36*b*, a delay element 36 and fuse material container 37. With further reference to FIG. 2, storage and transportation clip 42 including end pieces 43, 46 (46 not shown) and central spring section 47 provide additional protection to avoid premature initiation. Clip 42 is removed prior to preparation for use of device 10. The removal of cotter pin 35 by pulling its ring is the final step in preparation for use of device 10. When device 10 is thrown handle 32 is ejected to initiate ignition. Handle portion 32*s* limits movement of handle 32 toward and against body wall 15*a*.

Figure 3:
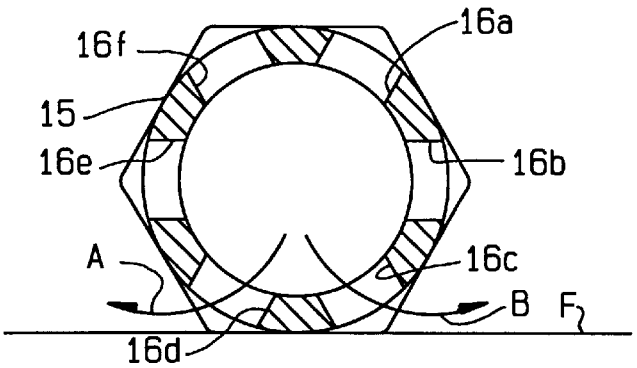
FIG. 3 is a sectional view along line 3—3 of FIG. 2.

Turning to FIG. 3, central body portion 15, end portion 13 and a uniformly radially spaced row of vent holes 16 are shown.

Referring back to FIG. 1, body 15 has three (3) rows $r_1$, $r_2$, and $r_3$ of vent holes 16. Row $r_1$, includes six (6) holes 16*a*–16*f* spaced uniformly 60° apart. Holes 16 are placed in relation to body end portions 12, 13 to prevent any obstruction to venting of pyrotechnic reaction gases. For example, as device 10 rests on floor (F) (FIG. 3), gases are able to vent through holes 16*c* and 16*d* without resistance since neither holes 16*c* or 16*d* engages floor F (FIG. 3).

Vent holes 16 are positioned on and uniformly spaced-apart on the body surface 15*a* so that when the gases of combustion exit holes 16 the reactive forces cancel one another preventing device 10 from being propelled by jet reaction a substantial distance or with any substantial speed. If in operation, device 10 is activated when spaced from a floor or other surface (i.e. during its trajectory flight after being thrown), there is a lack of reactive forces due to escaping gases that would effect any movement of device 10. If device 10 is activated while positioned on a surface, such as floor (F) as illustrated in FIG. 3, the confinement of gases escaping, as distinguished from reactive gas forces from venting gases against floor (F), may increase pressure to cause device 10 to move upwardly off the floor (F) a few inches. Such small movement of device 10 at a low rate of speed presents no threat to personnel in the area.

In the preferred embodiment, each vent hole 16 is of the same diameter, each row of holes spaced uniformly and each vent hole in each row is equally spaced radially to assure no resultant propelling forces are created. Vent holes 16 may, alternatively, vary in size and be non-uniformly positioned provided they are properly located so that no resultant propelling forces are created by exiting gases.

Due to the polygonal (i.e hexagonal) body ends 12, 13 device 10 when thrown onto or deployed on a flat surface, device 10 will resist rolling.

Preferably, device 10 weighs about 8 ounces and has a length from end 12 to lever pivot 32*p* of about 5.25 inches. Cylindrical portion 15 of body 11 is 1.50 inches in diameter. Holder 26 preferably has an inside diameter of 0.620 and a length of 1.9 and is loaded with about 5 grams of distraction material. The device produces a minimum of 170–180 decibels of noise level at 5 feet accompanied by a light flash level of a minimum of 2.0 million candle power. Aluminum body 11 and charge holder 20 including its wall 22*w* has sufficient integrity to prevent hand gun ammunition from penetrating to an extent to cause material 40 to initiate.

In operation of device 10, safety lever 32 is unlatched by removing pin 35 while the operator continues to grip safety lever 32. Device 10 is thrown a distance by the operator. During its flight, lever 32 is swung about handle pivot 32*p* allowing striker spring 29 to rotate striker 28 against primer 30. As primer 30 is struck a flash of burning primer material ignites delay element 36 which burns for a short period of time (about 1.5 seconds) followed by ignition of the fuse output charge 37 that breaches the isolation disk 23 and ignites the distraction device pyrotechnic charge 40. The distraction charge reaction instantly causing end closure 27 to separate from charge holder portion 22. Such separation contributes to the audio signal and light flashes through body vent openings 16. Gaseous products of combustion exit through holes 16 while primer 30 including its crown 34*a* prevent gas exiting passage in head 24.

Once device 10 has cooled down to permit handling, holder unit 20 along with the rest of fuse assembly adaptor head 9, is replaced by unscrewing such unit and adaptor head 9 from body 11. A new holder unit 20 and a new fuse X assembly adaptor head 9 is then attached threadedly to body 11. No tools are required. Device 10 is then reloaded and ready for reuse. This operation can be repeated for a dozen or more times.

Pyrotechnic material 40 normally creates a minimum of smoke but it may be formulated to create smoke or to include irritants or dyes.

We claim:

1. A distraction device having an energetic pyrotechnic material charge comprising a) a body including a central cylinder portion with an exterior side wall and polygonal ends;

b) a charge holder in the device for holding the energetic pyrotechnic charge;

c) means for igniting the energetic pyrotechnic charge; and d) vent holes in said exterior side wall for venting the gases of combustion which holes are so sized and located in the exterior side wall so that there is a lack of resulting device-propelling forces that would cause the device to be propelled a substantial distance.

2. The distraction device of claim 1 in which the polygonal ends are sized and have surfaces such that the vent holes in the exterior side wall are spaced from any surface on which the device rests.

3. A distraction device having an energetic pyrotechnic material charge for positioning on a planar surface comprising a) a body, b) exterior side walls forming part of the body and the body having a first dimension which is the distance once around the body side walls and body ends having a second dimension which is the distance once around one of the ends where the second dimension is longer than the first dimension;

c) a charge holder in the device for holding the energetic pyrotechnic charge;

d) means for igniting the energetic pyrotechnic charge to create gases of combustion;

e) vent holes in the side walls of the device for venting the gases of combustion which holes are so sized and located so that there is a lack of resultant device-propelling forces that would cause the device to be propelled a substantial distance; and f) the body ends being polygonal and being sized and having surfaces such that the vent holes in the side walls are spaced from any surface on which the device rests.

4. A distraction device having an energetic pyrotechnic material charge for positioning on a planar surface comprising a) a hollow body, b) exterior side walls forming part of the body;

c) a charge holder in the device for holding the energetic pyrotechnic charge, the charge holder in turn comprising;

i) the hollow holder body;

ii) an isolation disk; and iii) an end closure which holder body, isolation disk and end enclosure provide a sealed storage area for said energetic pyrotechnic charge;

d) means for igniting the energetic pyrotechnic charge to create gases of combustion; and e) means for spacing the side walls from such planar surface; and f) vent holes in the side walls of the device for venting the gases of combustion which holes are so sized and located so that there is a lack of resultant device-propelling forces that would cause the device to be propelled a substantial distance.

5. The distraction device of claim 4 in which the device includes ignition means having fuse material which fuse material during activation penetrates such isolation disk to ignite the energetic pyrotechnic material causing the end closure to separate from the body portion.

6. A distraction device having an energetic pyrotechnic material charge for positioning on a planar surface comprising a) a body, b) exterior side walls forming part of the body;

c) a charge holder in the device for holding the energetic pyrotechnic charge;

d) means for igniting the energetic pyrotechnic charge to create gases of combustion; and e) means for spacing the side walls from such planar surface; and f) vent holes in the side walls of the device for venting the gases of combustion which holes are so sized and located so that there is a lack of resultant device-propelling forces that would cause the device to be propelled a substantial distance; and g) in which the device cools rapidly to permit reloading in a short period of time after use.

7. A distraction device having an energetic pyrotechnic material charge for positioning on a planar surface comprising a) a body having a central cylindrical portion, b) exterior side walls forming part of the body;

c) a charge holder in the device for holding the energetic pyrotechnic charge;

d) means for igniting the energetic pyrotechnic charge to create gases of combustion;

f) vent holes in the side walls of the device for venting the gases of combustion which holes are so sized and located so that there is a lack of resultant device-propelling forces that would cause the device to be propelled a substantial distance; and g) polygonal ends on the body sized to space the central body portion from any surface on which the device rests.

8. A distraction device having an energetic pyrotechnic material charge for positioning on a planar surface comprising a) a body, b) exterior side walls forming part of the body;

c) a charge holder in the device for holding the energetic pyrotechnic charge, said charge holder having an attached end piece that becomes detached without rupture;

d) means for igniting the energetic pyrotechnic charge to create gases of combustion; and e) means for spacing the side walls from such planar surface; and f) vent holes in the side walls of the device for venting the gases of combustion which holes are so sized and located so that there is a lack of resultant device-propelling forces that would cause the device to be propelled a substantial distance.

* * * * *